United States Patent [19]

Wöhrle et al.

[11] 4,199,135

[45] Apr. 22, 1980

[54] FOLDABLE WORKBENCH

[75] Inventors: Rudolf Wöhrle, Rieden; Roland Unterstab, Schnuttenbach; Herbert Köber, Kotz, all of Fed. Rep. of Germany

[73] Assignee: Firma Alois Kober KG, Grosskötz, Fed. Rep. of Germany

[21] Appl. No.: 923,699

[22] Filed: Jul. 11, 1978

[30] Foreign Application Priority Data

Jul. 29, 1977 [DE] Fed. Rep. of Germany ..... 2734343

[51] Int. Cl.[2] ..... B23Q 3/02

[52] U.S. Cl. ..... 269/100; 269/252; 269/321 A; 269/321 CF

[58] Field of Search ..... 269/139, 321 CF, 321 A, 269/97–100, 91, 95, 290–295, 279, 283, 246, 247, 252–253, 257, 258; 144/286 R, 286 A, 288 R

[56] References Cited

U.S. PATENT DOCUMENTS

| | | | |
|---|---|---|---|
| 1,954,708 | 4/1934 | Mass | 269/321 A |
| 2,020,222 | 11/1935 | Tautz | 144/288 R |
| 2,381,584 | 8/1945 | Fulleton | 269/321 N |
| 2,526,020 | 10/1950 | Fuhr | 269/252 |
| 2,621,807 | 12/1952 | Rendich | 269/321 A |
| 4,061,323 | 12/1977 | Beekenkamp | 269/244 |
| 4,127,260 | 11/1978 | Hickman | 269/321 CF |

*Primary Examiner*—Robert C. Watson
*Attorney, Agent, or Firm*—Karl F. Ross

[57] ABSTRACT

A workbench has a pair of rigid wooden work plates bridging and fixed to a pair of transverse support elements from which extend legs constituting a foldable stand. The work plates are each formed with a plurality of throughgoing bores into which pegs of a clamp and holding blocks may fit, these pegs being smaller than the bores so that the blocks and clamp tip when acted upon parallel to the work surface. The faces of the blocks and clamp are inclined to be perpendicular to the work surface when the pegs are thus tipped. The legs of the stand can fold parallel to each other and flat against the work table when the workbench is not in use.

31 Claims, 11 Drawing Figures

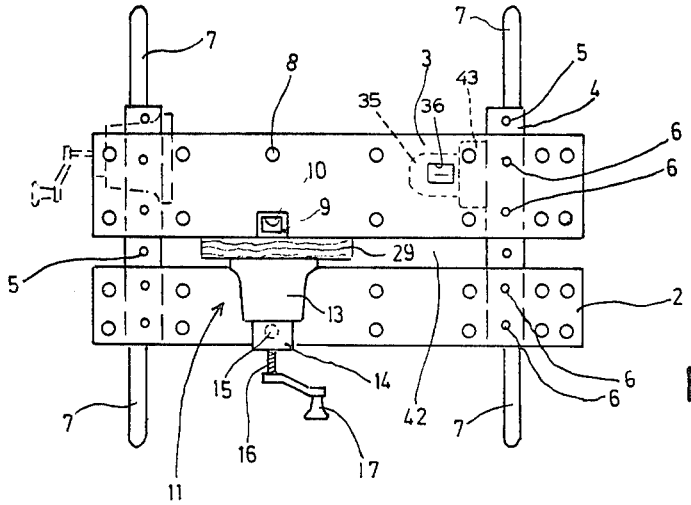
Fig. 1
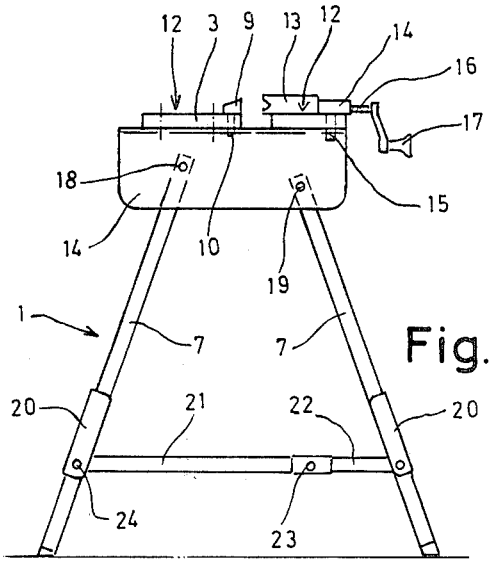
Fig. 2
Fig. 7
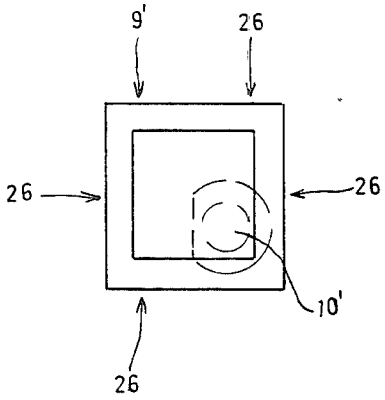
Fig. 6
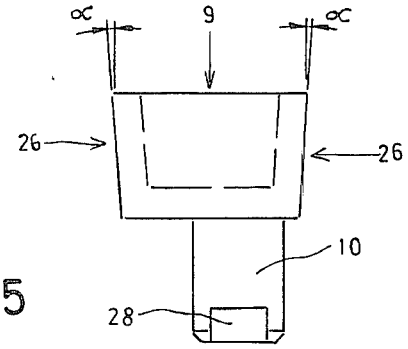
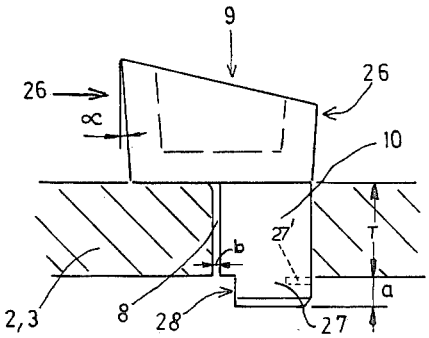
Fig. 5

Fig.9
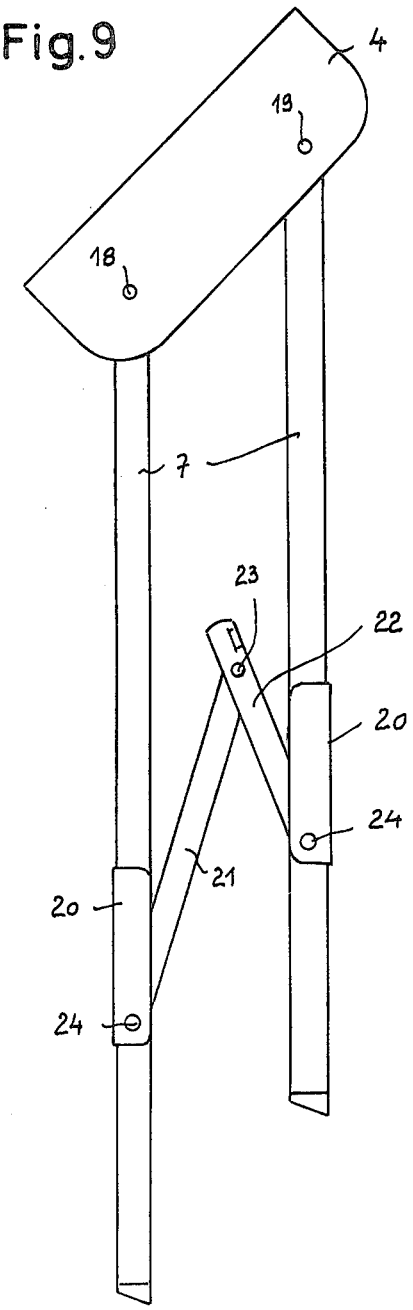
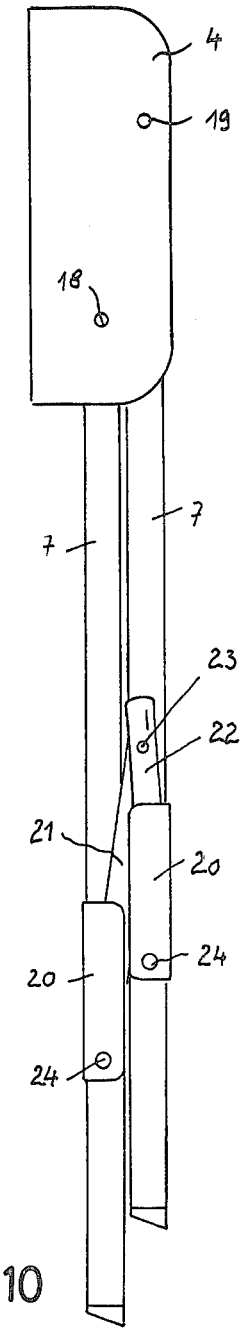
Fig.10

FOLDABLE WORKBENCH

FIELD OF THE INVENTION

The invention relates to a workbench, and particularly concerns a workbench for use in the home. Such benches are often referred to as do-it-yourself or handyman's workbenches.

BACKGROUND OF THE INVENTION

A workbench disclosed in British Patent No. 1 267 032 has a work table comprising two beams or plates. One of the work plates is screwed securely to a support structure or stand, while the other work plate is displaceably guided on the support structure and is adjustable by means of two parallel spindles. This makes it possible for workpieces to be clamped in position between the work plates which can be moved relatively to each other, it also being possible for the movable work plate to be adjusted to an inclined position to enable wedge-shaped workpieces to be clamped in position. The surfaces of both work plates form a single working surface. Stops or holding blocks projecting from the working surface may be inserted into the work plates to permit workpieces resting on the working surface to be clamped between the stops for clamping by the work plates.

It has been found that such known workbenches of this construction are still unable adequately to meet the variable requirements of the home-worker or handyman. The angular or inclinable adjustability of the work plates is of lesser importance because the handyman can resort to other known means for clamping wedge-shaped workpieces in position. The stability of the workbench and the possibility of clamping and treating workpieces of any size and shape is of much greater importance.

OBJECTS OF THE INVENTION

It is therefore an object of the invention to provide a workbench for use in the home or do-it-yourself purposes which is of a simpler construction than the known workbenches and which permits it to be used more comprehensively for clamping and treating workpieces of various shapes and sizes.

It is a particular object of the invention to make it possible to clamp and treat workpieces which cannot be clamped in position when the known workbenches are used.

SUMMARY OF THE INVENTION

According to one aspect of the invention a workbench comprises a work table having throughgoing bores, a clamp with a stationary body part, a peg projecting from the body part for insertion in one of the bores, a movable jaw part carried by the body and adjusting means for moving the jaw in relation to the body, and a holding block having an abutment surface, wherein when the peg of the clamp is inserted in a bore a workpiece can be clamped between the movable jaw part and the abutment surface of the holding block.

According to another feature of this invention each of the holding blocks and the clamp are fixed on the work surface by means of the above-mentioned pegs which fit into the bores formed in the plates forming the work surfaces. These pegs and bores are cylindrical, but the pegs are somewhat smaller, by a predetermined difference, than the bores. The clamping face of the clamp and holding faces of the blocks are inclined to the respective pegs at an angle so that when the respective pegs tip in the bores as a result of a force acting on them, these faces will be perfectly perpendicular to the work surface. At the same time when not tipped insertion and removal of these pegs is very easy.

In accordance with another feature of this invention a support structure or stand for a work table comprises two pairs of legs and means for supporting the work table connected to the pairs of legs and having one or more holes for receiving threaded securing means for securing the work table to the supporting means.

BRIEF DESCRIPTION OF THE DRAWING

FIG. 1 is a plan view of a workbench according to this invention;

FIG. 2 is a side elevational view of the workbench of FIG. 1;

FIGS. 5, 6, and 7 are respectively a side elevation, a front elevation and a plan view of holding blocks provided for the workbench of FIGS. 1 and 2 in enlarged scale;

FIG. 9 is a corresponding side elevation showing an intermediate position during the folding of the structure; and FIG. 10 shows a side elevation of the structure shown in FIGS. 8 and 9 in the fully folded or collapsed condition.

SPECIFIC DESCRIPTION

Figure 3:
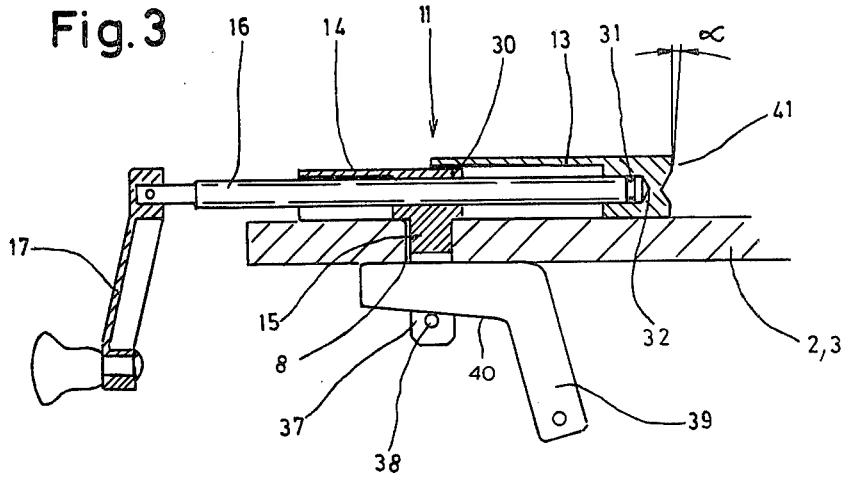
FIG. 3 is a longitudinal section in enlarged scale through a clamp for the workbench of FIGS. 1 and 2.

Referring to the drawing, FIGS. 1 and 2 show a workbench having a stand 1 comprising four tubular legs 7 two of which are hinged on coaxial horizontal pivots 18 and two of which are hinged on coaxial horizontal pivots 19 provided on two L-section support members 4 which are spaced horizontally apart. In the erected or spread apart position shown in FIG. 2 the legs 7 are braced by two pairs of struts 21 and 22 which are hinged to the legs 7 at pivots 24 and interconnected at a common knee joint or pivot 23. At the knee joint 23 each pair of struts 21 and 22 is provided with a catch 25 (FIG. 8) preventing unintentional movement from the extended straight position to the collapsed or folded position.

The L-section supports 4 are of sheet metal and each has an upright (as viewed in FIG. 2) longer flange which forms a reinforcement and on the inside surface of which the legs 7 are mounted. A work table formed by two horizontal, flat beams or work plates 2 and 3 is screwed by screws 6 to the horizontal flanges of the support member 4. The horizontal flange of each L-section support 4 is provided with a plurality of additional holes 5 enabling one or both of the work plates 2 and 3 to be screwed to the side support 4 at various distances apart. Since the stand 1 and the work plates 2 and 3 are screwed securely together, a rigid three-dimensional structure results, permitting the foot plates generally provided in the known workbenches for holding the workbench in a stable position to be dispensed with. The upper sides of the work plates 2 and 3 form a common work surface 12 on which both small and large workpieces can be clamped in position. Workpieces of any shape can be held since the clamping device hereinafter described permits adjustment to practically any workpiece being worked on by the handyman or homeworker.

The work plates 2 and 3 are provided with numerous throughgoing holes or bores 8. Pegs 10 of holding blocks 9 may be inserted into these holes 8. Also, one or more clamps 11 (see FIGS. 3 and 4) can also be inserted into the same holes 8.

The plate 3 as shown in FIG. 1 is formed with a large throughgoing passage 36 and the one plate 4 has a holder 43 for an attachment such as a power jig saw 35 whose blade extends up through the passage 36 above the surface 12. The attachment holder 43 itself may have a part coplanar with the surface 12.

The clamp 11 comprises a clamping part or jaw 13 movable along the working surface 12 and guided on a stationary body or clamp part 14 provided with a peg 15 by which it can be engaged in one of the holes 8. Adjusting means in the form of a spindle or screw 16 operable by a crank 17 is guided in the basic body 14 for adjusting the relative positions of the parts 13 and 14. The spindle 16 is guided in the clamping jaw 13 in such a way as to be rotatable, but fixed in the axial direction.

FIG. 1 shows that the basic body 14 of the clamp 11 can be provided at any optical position of the workbench at which a hole 8 is available. Since the basic body 14 has only a single peg 15, the clamp 11 can swivel about that peg 15 and thus facilitate adjustment of the direction of movement of the clamping jaw 13 to the shape of a workpiece 29 to be clamped in position.

The embodiment shown in FIG. 1 illustrates the clamping of a workpiece 29 between a clamping jaw 13 and a holding block 9. The workpiece 29 is inserted in an upright or up-ended position into a clearance or gap 42 between the plates 2 and 3. Workpieces of larger dimensions are braced by two blocks 9, the clamp 11 being then arranged in such a way as to ensure that its clamping jaw 13 ensures three-point bracing of such a workpiece.

The position indicated by dash-and-dot lines in FIG. 1 illustrates the possibility of fitting the clamp 11 on the narrow side of the work plates 2 and 3 to clamp it along the longitudinal sides thereof. This permits very wide workpieces to be clamped in position. In any case, substantially the whole length of the workbench shown can be utilised for clamping workpieces in position. It will also be readily understood that two or more clamping devices 11 may be used on one and the same workbench.

Figure 4:
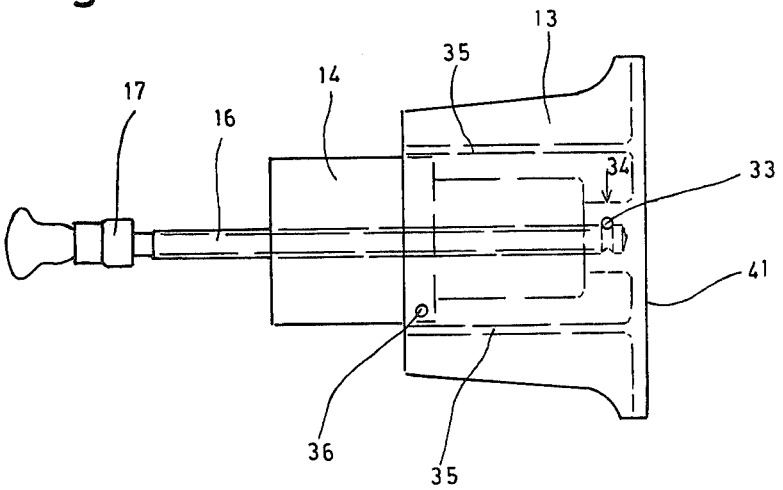
FIG. 4 is a plan view of the clamping device of FIG. 3.

FIGS. 3 and 4 show the manner in which the spindle 16 is guided in the basic body 14 with the aid of a nut formation 30 therein. The end of the spindle screw 16 engages in a bore 32 formed in the clamping jaw 13 and is locked axially by a snap ring 33 (FIG. 4) which engages peripherally in a groove 31 provided in the spindle 16. FIG. 4 shows that the bore 32 may also be in a separate bearing 34 permitting the use of a clamping jaw of a simpler construction, since in this case the ring 33 is effective not only to fix the spindle 16 axially but, in addition, to center the bearing 34 which has, however, to be guided on the upper or underside in order to ensure that it swivels exclusively about the ring 33, this swivel motion being, however, impeded by engagement of the spindle 16 in the bore 32.

The peg 15 of the stationary part 14 is formed with an axially open longitudinal slot 37 across which a diametrical pin 38 passes. A clamping wedge 39 can be inserted below the beams 2 and 3, into the longitudinal slot 37, with its inclined lower edge 40 ensuring that the peg 15 is braced by the clamping wedge 39 relatively firmly in relation to the beams 2 and 3. The clamp 11 is thus reliably prevented from being lifted off the beams 2 and 3 during the clamping operation.

The clamping jaw 13 is provided with guide beads or strips 35 between which the part 14 is guided. A stop pin 36 prevents detachment of the clamping jaw 13 from the basic body 14.

It will be understood that there is a certain amount of play between the peg 15 and the wall of the hole 8 in a beam 2 or 3. This play may cause tilting or canting of the peg 15 when the clamp 11 is subjected to the stress of the clamping force. Owing to the presence of the guide 35, the clamping jaw 13 tilts also. For this reason, the clamping surface 41 of the clamping jaw 13 is bevelled at an angle $\alpha$ so that the lower edge of the clamping face 41 is inclined downwardly and rearwardly toward the work beams 2 and 3. The angle $\alpha$ corresponds substantially to the angle of tilt of the peg 15 in the bore 8 where the play is indicated at b in FIG. 5. It is thus ensured that upon application of the full pressure the whole surface of the clamping face 41 remains flat against the workpiece. Furthermore, stop faces 26 of the blocks 9 (shown in FIGS. 5 to 7) are correspondingly bevelled at the angle as described with reference to the clamping face 41 shown in FIG. 3, since the pegs 10 of the stop members 9 in the bores 8 also have a certain amount of play and tilting thereof may thus also occur. The plates 2 and 3 have a thickness T so that $\alpha = \arctan b/T$.

In one modified embodiment (FIGS. 6 and 7), the peg 10' of a block 9' is provided eccentrically thus permitting variation of the shortest distances between the longitudinal axis of the peg 10' and the individual abutment faces 26. The distance between the individual block 9' and the clamping face 41 of the clamp 11 may be varied by turning the block through 90°. One of these distances between the peg 10' and a clamping face 26 is so selected as to ensure that when the stop 9 is inserted into one of the bores 8 of a series of bores adjacent the edge of the work plate 3 the abutmetn face 26 is substantially flush with that edge of the beam 3 (FIG. 1). The abutment face 26 may also project slightly from the edge of the beam 3. In any case, the workpiece 29 (FIG. 1) is clamped between the stop faces 26 and the clamping face 41 only when it is to be clamped in a position in which it passes through the gap 42, that is to say in an upright or upended position.

FIG. 5 shows that the length and diameter of the peg 10 respectively exceed the thickness of the work plate 2,3 by the amount a equal to 5 mm, and the diameter of the bore 8 by a distance b. A plane stop face or flat 28 similar to a key face is provided at the projecting end 27 of the peg. When a thin plate is to be clamped to the work surface 12 of the work table, the block 9 can be lifted from the position shown in FIG. 5 and then be inserted upwardly through the work plates 2 and 3 so that the portion 27 of the peg projects slightly from the working surface 12. The narrow edge of the flat or laminar workpiece can then abut the plane stop face 28. So long as there is still play between the clamp and the workpiece as well as the holding block 9, the block 9 is held manually in position in order to prevent it from sliding automatically out of the hole 8. However, the projecting portion 27 of the peg may also be provided with a small radial bore 27' into which a pin preventing the block 9 from falling off may be inserted.

When the workbench is to be used for rough operations, such as filing, planing, drilling or the like, in the horizontal direction the steadiness of the workbench is increased by fitting one of the pairs of legs 7 with a reinforcing slab 20 (FIG. 2) thus permitting full utilization of the other leg for bearing the main weight.

Figures 8, 8A:
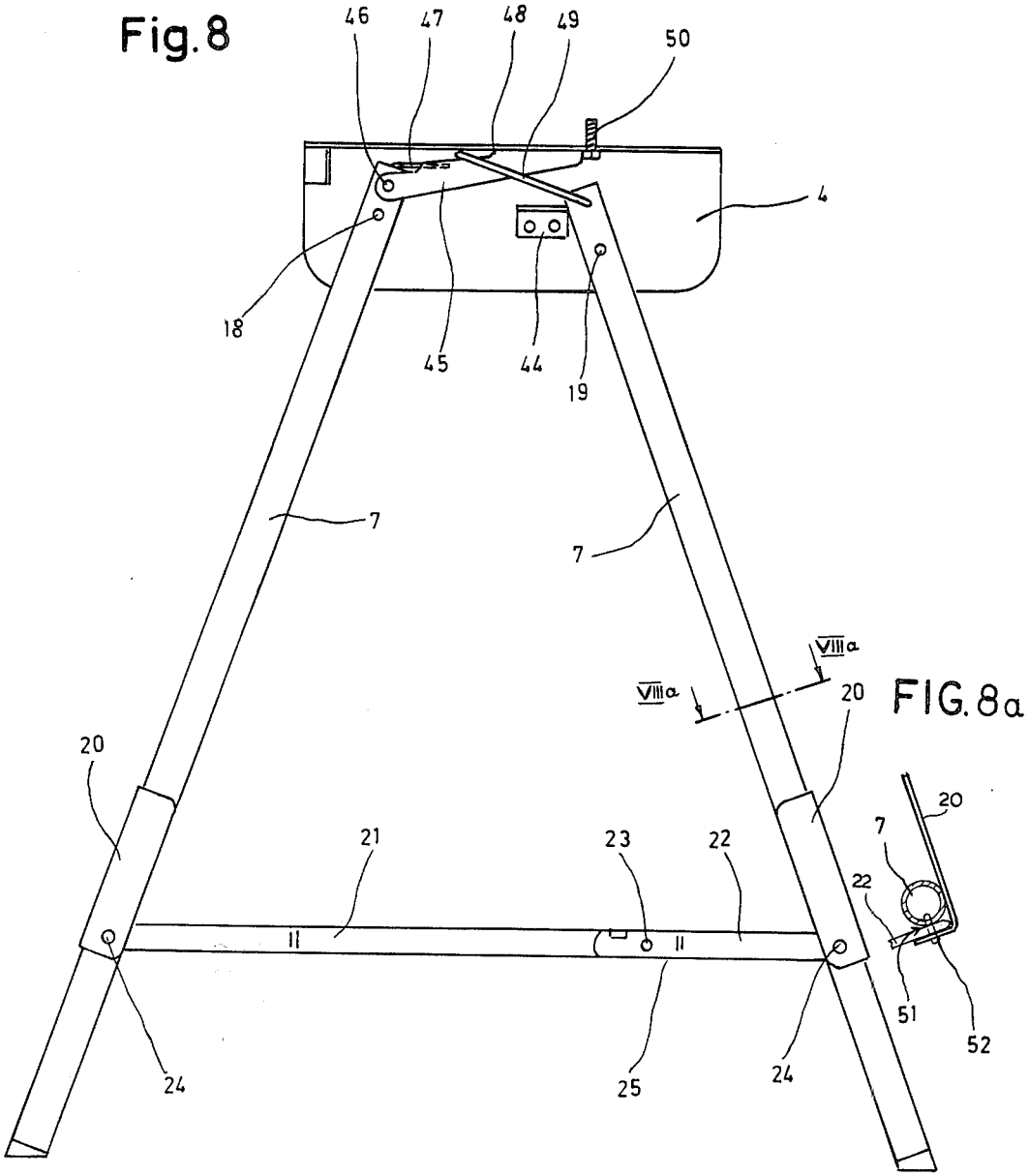
FIG. 8 is a side elevation of a collapsible stand or trestle for a second workbench (without work plates) in the erected position.
FIG. 8*a* is a section taken along line VIII*a*—VIII*a* of FIG. 8.

Referring now to FIGS. 8 to 10 there is shown a support stand or trestle which at little expenditure on structural parts can be collapsed or folded together so closely that it requires very little packing space for transport or storage. It will be understood that this support system may advantageously also be used in workbenches of different construction.

In the use position shown in FIG. 8, the swivel motion of the legs 7 is limited at their lower ends by the extended struts 21 and 22 and at their upper ends by stops 44 and 50. The upper edge of the shorter leg 7 (the right hand one as viewed in FIG. 8) which pivots about the pivot 19 rests against the stop 44 which is screwed to the side of the support plate 4. The longer leg 7 is pivotable about the pivot 8 which is disposed at a higher level on the plate 4. An extension or pawl 45 is hinged to the upper end of the leg 7 at the pivot 46. The pawl 45 is subject to the action of a torsion spring 47 which urges it in the counterclockwise direction (FIG. 8) about the pivot 46 so that the free end of the pawl 45 contacts the underside of the horizontal web of the angle plate 4 and strikes against a stop 50 formed by the head of a screw by which one of the two beams 2 or 3 is secured (FIG. 1). The upper edge of the pawl 45 is provided with a stop cam 48 over which a hoop 49 hinged to the shorter leg 7 may escape.

The two struts 21 and 22 are locked together by a catch 25 to prevent downward sagging of the knee joint 23 when the struts 21 and 22 are in the extended position. However, the knee joint 23 with the struts 21 and 22 can be flexed manually upwardly with the result that the short leg 7 on which the strut 22 is mounted is turned in the clockwise direction about the pivot 19 which is disposed at the lower level. This rotation causes the loop 49 to pull the strut 45 downwardly and the strut 45 is thus disengaged from the stop 50. The longer leg 7 can then also pivot about its pivot 18 at the higher level. After passing through the partially folded position shown in FIG. 9 in which the two legs 7 assume substantially parallel positions the strut 22 contacts its associated cover plate 20 as shown in FIG. 8a. An angular portion 52 of the plate 20 extends to a position beyond the leg 7 to form a stop recess or gap 51 in which the strut 22 engages. The stop recess 51 limits the swivel path of the strut 22. It will also be noted that the angle plate 4 in this partially folded condition assumes an inclined position with respect to the legs.

When the side members 4 and the work plates 2 and 3 secured thereto are turned further on these pivots 18 and 19, the legs 7 approach each other to assume the fully folded position shown in FIG. 10 as the beams 2 and 3 also assume positions parallel to the legs 7. The plates 20 may be formed as horizontal steps for climbing on the workbench of this invention.

The erection of the folded workbench proceeds in reverse order without the necessity of having to dismantle or assemble any structural parts.

It will be understood that the invention may take forms other than those shown and described above. Thus special clamping devices can be inserted into the bores of the beams. Clamping jaws which are movable in a direction at right angles to the working surface and by which tubes, rods and the like may be bent, may be used. Moreover the horizontal plane of movement of the clamping jaws at a distance from the working surface may be fixed to facilitate the treatment of metallic objects.

It will be understood that the principal difference between a workbench embodying the invention and as described above and the known workbenches, consists chiefly in that the work table does not serve directly as a movable clamping element. This ensured that the stability of a workbench embodying the invention considerably exceeds that of known workbenches, since the support structure and the work table form a rigid, three-dimensional structure. The clamp can be used at any position at which a corresponding hole is provided in exactly the same manner as hitherto employed in the arrangement of stops. The clamp itself is provided with a peg for insertion into the holes and can thus be swivelled about that peg and be adjusted to the shape of the workpiece to be clamped in position.

Broad workpieces resting on the working surface can also be clamped in position, because the clamping device may be inserted along the narrow side as well as along the longitudinal side of the workbench. The handyman or home-worker can therefore use several such clamping devices commercially available as independent accessories. A workbench embodying the invention also permits work pieces to be clamped in position without the necessity of having to move the work plates toward each other, since in one embodiment of the invention the stops are so constructed as to enable their stop faces to come to lie flush with or to project from the edge of the work plates so that the clearance between the work plates merely serves as a passage for the workpiece. One of the work plates can advantageously be moved along the support structure and fixed in the displaced position for the purpose of adjusting the distance between the work plates to the respective requirements.

We claim:

1. A workbench comprising:

two rigid plates each having a substantially planar surface and each formed with a plurality of bores centered on respective bore axes and substantially perpendicular to the respective surface;

a pair of horizontally spaced support elements;

means fixedly securing said plates to said support elements with said plates spaced from each other and said surfaces coplanar to form a work surface;

a plurality of legs mounted on said support elements and each displaceable between a folded-up position lying against said plates and a folded-down position extending downwardly from said plates;

at least one holding block having a block peg engageable in any of said bores with said block lying on said work surface and having at least one holding face generally parallel to said block peg and transverse to said work surface when said block peg is engaged in one of said bores, said block being pivotal when said block peg is engaged in one of said bores about the respective bore axis, whereby said holding face can be directed in any desired transverse direction generally parallel to said work surface by pivoting said block about the bore axis of the bore in which said block peg is engaged;

a clamp having a stationary part provided with a clamp peg engageable in any of said bores with said stationary part on said work surface, a movable part provided with at least one clamping face generally parallel to said clamp peg and transverse to said work surface when said clamp peg is engaged in one of said bores, means including interfitting guides on said parts for displacement of said movable part substantially only perpendicularly to said clamp peg relative to said stationary part, and means for relatively displacing said parts, said clamp being pivotal when said clamp peg is engaged in one of said bores about the respective bore axis, whereby said clamping face can be directed in any desired transverse direction generally parallel to said work surface by pivoting said stationary part about the bore axis of the bore in which said clamp peg is engaged and a workpiece can be clamped between said clamping face of said movable part and said holding face of said holding block; and means for securing said stationary part of said work surface at any of said bores against displacement perpendicular to said work surface.

2. The workbench defined in claim 1 wherein said means for securing said stationary part is engageable with said clamp peg and with the faces of said plates opposite said work surface.

3. The workbench defined in claim 1 wherein said stationary part is provided with a guide for said movable part, said means for relatively displacing including a threaded spindle engaged between said parts.

4. The workbench defined in claim 3 wherein said spindle has opposite ends, one of said parts being provided with means engaging one of said ends and preventing longitudinal displacement thereof in said one part, the other part being provided with a nut formation threadedly engaging said spindle.

5. The workbench defined in claim 4 wherein said one part is provided at said one end with a bearing receiving said one end.

6. The workbench defined in claim 3 wherein said movable part is generally trapezoidal in section and has a broad side engaging said work surface.

7. The workbench defined in claim 3 wherein said clamp further comprises means for limiting the relative displacement between said parts for preventing separation of said parts beyond a predetermined spacing.

8. The workbench defined in claim 3 wherein said movable part has a clamping face having a pair of edges one of which lies generally on said work surface and the other of which lies spaced from said work surface, said face being generally planar and inclined to said work surface with said other edge being further from to said stationary part than said one edge.

9. The workbench defined in claim 8 wherein said face lies at an acute angle to said work surface, said pegs being cylindrical and having a predetermined peg diameter and said bores being cylindrical and having a predetermined bore diameter greater by a predetermined distance than said peg diameter, said plates having a predetermined thickness, said angle being equal substantially to arctan (distance/thickness), whereby when said clamp peg is tipped in said bore said clamping face is substantially perpendicular to said working surface.

10. The workbench defined in claim 1 wherein said holding block has a plurality of such holding faces generally perpendicular to said block peg, said block peg being eccentrically positioned on said block with respect to said holding faces.

11. The workbench defined in claim 10 wherein said holding faces are four in number and are generally perpendicular to one another.

12. The workbench defined in claim 1 wherein said holding face has a pair of edges one of which lies generally on said work surface and the other of which is spaced from said work surface and is spaced inwardly on said block from said one edge.

13. The workbench defined in claim 12 wherein said face lies at an acute angle to said work surface and to the axis of said block peg, said pegs being cylindrical and having a predetermined peg diameter and said bores being cylindrical and having a predetermined bore diameter greater by a predetermined distance than said peg diameter, said plates having a predetermined distance than said peg diameter, said plates having a predetermined thickness, said angle being equal substantially to arctan (distance/thickness), whereby when said block peg is tipped in said bore said holding face is substantially perpendicular to said working surface.

14. The workbench defined in claim 13 wherein said block peg has a length greater than said thickness.

15. The workbench defined in claim 14 wherein said peg is formed with a substantially planar flat at its portion projecting beyond the face of said plates opposite said working surface and said flat is generally parallel to the block-peg axis.

16. The workbench defined in claim 1 wherein at least one of said bores is a predetermined distance from a longitudinal edge of the respective plate, said holding block having a holding face spaced from said holding peg by a distance equal generally to said predetermined distance, whereby said holding face can be aligned generally coplanar with said longitudinal edge when said block peg is in said one bore.

17. The workbench defined in claim 1 wherein said means fixedly securing can secure one of said plates in any of several positions relative to the other plate on said support elements.

18. The workbench defined in claim 17 wherein said support elements are formed with a plurality of holes for at least said one plate, said means fixedly securing including screws engageable through said holes with said one plate.

19. The workbench defined in claim 1 wherein one of said plates is formed with a throughgoing passage, said workbench further comprising means for holding a cutting power tool underneath said one plate with its blade extending through said passage above said working surface.

20. The workbench defined in claim 1, further comprising a horizontal member interconnecting some of said legs and constituting a step.

21. The workbench defined in claim 1 wherein two pairs of such legs are provided, one leg of each pair being pivoted on one of said support elements and the other leg of each pair being pivoted on the other support element, said workbench further comprising a pair of struts having pivoted together inner ends and outer ends each pivoted on a leg of a respective pair.

22. The workbench defined in claim 21, further comprising horizontal support members each extending between the legs of a respective pair of said legs.

23. The workbench defined in claim 22 wherein each of said support members forms a stop with which the respective leg is engageable in said folded-up position.

24. The workbench defined in claim 23 wherein each of said support members has a bent over end forming with the respective said stop.

25. The workbench defined in claim 21 wherein said legs have at their upper ends pivots connecting themselves to said support elements, said pivots of said one pair being above the pivots of the other pair of said legs.

26. The workbench defined in claim 25, further comprising means for locking said legs in said folded-down positions and including a fixed stop on one of said support elements and a pawl on said one pair of legs engageable with said stop.

27. The workbench defined in claim 26, further comprising means on said other pair of legs for pivoting said pawl out of engagement with said stop and including a cam on said pawl.

28. The workbench defined in claim 27 wherein said legs are generally parallel and in contact with one another in said folded-up position.

29. The workbench defined in claim 27, further comprising a torsion spring urging said pawl into engagement with said stop.

30. A workbench comprising:

two rigid plates each having a substantially planar surface and each formed with a plurality of bores substantially perpendicular to the respective surface;

a pair of horizontally spaced support elements;

means fixedly securing said plates to said support elements with said plates spaced from each other and said surfaces coplanar to form a work surface;

a plurality of legs mounted on said support elements and each displaceable between a folded-up position lying against said plates and a folded-down position extending downwardly from said plates;

at least one holding block having a block peg engageable in any of said bores with said block lying on said work surface;

a clamp having a stationary part provided with a clamp peg engageable in any of said bores with said stationary part on said work surface and formed with a slot extending generally diametrically through said clamp peg, a movable part, and means for relatively displacing said parts, whereby a workpiece can be clamped between said movable part and said holding block; and means including a wedge engageable in said slot and with said plates for securing said stationary part on said work surface at any of said holes against displacement perpendicular to said work surface.

31. A workbench comprising:

two rigid plates each having a substantially planar surface and each formed with a plurality of bores substantially perpendicular to the respective surface;

a pair of horizontally spaced support elements;

means fixedly securing said plates to said support elements with said plates spaced from each other and said surfaces coplanar to form a work surface;

a plurality of legs mounted on said support elements and plates and a folded-down position extending downwardly from said plates;

at least one holding block having a block peg engageable in any of said bores with said block lying on said work surface and having at least one holding face generally perpendicular to said work surface;

a clamp having a stationary part provided with a clamp peg engageable in any of said bores with said stationary part on said work surface and having a clamping face generally perpendicular to said work surface, a movable part, and means for relatively displacing said parts, whereby a workpiece can be clamped between said clamping face of said movable parts and said holding face of said holding block; and means for securing said stationary part on said work surface at any of said bores against displacement perpendicular to said work surface, at least one of said pegs being receivable with play and limitedly cantable in any of said bores, the respective face of said one peg being positionable perpendicular to said work surface when said one peg is canted in any of said bores and forming an acute angle with said work surface when said one peg is coaxially aligned in any of said bores.

* * * * *